US006843172B2

(12) United States Patent
Polloni et al.

(10) Patent No.: US 6,843,172 B2
(45) Date of Patent: Jan. 18, 2005

(54) DEVICE FOR FEEDING CIGARETTE PACKETS OUT OF A PACKING MACHINE

(75) Inventors: Roberto Polloni, Modigliana (IT); Chiara Colo', Fiumalbo (IT); Fiorenzo Draghetti, Medicina (IT)

(73) Assignee: G.D. S.p.A., Bologne (IT)

( * ) Notice: Subject to any disclaimer, the term of this patent is extended or adjusted under 35 U.S.C. 154(b) by 29 days.

(21) Appl. No.: 10/332,561

(22) PCT Filed: Jul. 10, 2001

(86) PCT No.: PCT/IB01/01236

§ 371 (c)(1),
(2), (4) Date: Jan. 9, 2003

(87) PCT Pub. No.: WO02/04297

PCT Pub. Date: Jan. 17, 2002

(65) Prior Publication Data

US 2003/0146068 A1 Aug. 7, 2003

(30) Foreign Application Priority Data

Jul. 11, 2000 (IT) ..... BO2000A0419

(51) Int. Cl.[7] ..... B41F 1/07; B41F 17/00; B65G 47/52; B65G 19/32; B65G 23/00

(52) U.S. Cl. ..... 101/35; 101/32; 198/348; 198/415

(58) Field of Search ..... 101/26, 27, 32, 101/35; 219/121.71, 124.7; 198/348, 415

(56) References Cited

U.S. PATENT DOCUMENTS 3,730,133 A 5/1973 Cordiano et al.
4,263,766 A * 4/1981 Baker et al. ..... 53/50
5,074,400 A * 12/1991 Focke et al. ..... 198/415
5,315,927 A 5/1994 Yeh
6,098,533 A * 8/2000 Polloni et al. ..... 101/3.1

FOREIGN PATENT DOCUMENTS

| | | | | |
|---|---|---|---|---|
| EP | 905054 | | 3/1999 | |
| EP | 1199264 | * | 4/2002 | ..... B65G/47/52 |
| GB | 2053824 | * | 2/1981 | ..... B65G/23/00 |
| WO | 99/51498 | | 10/1999 | |

* cited by examiner

*Primary Examiner*—Edward Lefkowitz
*Assistant Examiner*—Marissa Ferguson
(74) *Attorney, Agent, or Firm*—Davidson Berquist Klima & Jackson LLP

(57) ABSTRACT

The invention relates to a device (1) for feeding cigarette packets (3) out of a packing machine, where the packets (3), being substantially in the shape of parallelepipeds, are moved forward with their large lateral faces (4) in contact with each other along a first path (P1) by a conveyor (2) that stabilises them in a defined direction (D) transversal to the large lateral faces (4). Downstream of the stabilising conveyor (2), there is a unit (33) for printing on the packets (3). Comprising a spacing conveyor (11, 19, 43) that separates the packets (3) from each other and feeds them along a second path (P2) along which there is a printing device (32) located at a printing position (35) on a section (T) of the second path (P2) and designed to print a preset sequence of characters and codes on defined portions of the faces of the packets (3), the action of the printing device (32) being controlled by a probe (36) that detects the presence of each packet (3) and by a control unit (37) connected to a sensor (38) that detects the instantaneous position of the spacing conveyor (11, 19, 43) relative to the packets (3) in order to synchronise the packets (3) with the motion of the conveyor (11, 19, 43).

21 Claims, 5 Drawing Sheets

DEVICE FOR FEEDING CIGARETTE PACKETS OUT OF A PACKING MACHINE

TECHNICAL FIELD

The present invention relates to a device for feeding cigarette packets out of a packing machine.

BACKGROUND ART

The invention can be used to good advantage in a cigarette packing machine, at the outfeed of which there is a stabilising and drying conveyor comprising two conveyor belts having two parallel, facing branches that move in a given direction and form between them a channel extending along a path of given length and whose width is substantially the same as the width of the cigarette packets.

The packets are held in contact with each other, usually along their large lateral faces, between the two conveyor branches so that they move along the conveyor, which is long enough to enable the glued parts of the packets to dry completely.

At the end of the conveyor, there is usually a printing device, of the laser or inkjet type, designed to print a sequence of letters and numbers forming corresponding codes on visible portions of the packets, following a control signal applied to it by a sensor that detects each single cigarette packets as it passes the printing zone.

These sensors, in order to be able to detect the line dividing two consecutive packets that are in close contact with each other and thus to identify the single packets, must be extremely sensitive and have a low depth of field. This feature, however, makes sensors of this kind unreliable. Indeed, a packet that moves even very slightly out of position may lead to a sensing error. Thus, for example, when a defective packet is rejected, a break is created in the row of packets moving along the feed channel. When this happens, the packets adjacent to the break may be angled slightly relative to the two facing branches of the conveyor, causing the sensor to issue an incorrect signal.

Furthermore, since the packets have to be held closely together between the conveyor belts for the full length of the conveyor so that the glued parts of the packets can dry properly without coming apart, so as to obtain a high quality end product, the parts of the packets that can be printed on are extremely limited.

DISCLOSURE OF THE INVENTION

The aim of the present invention is to provide a simple, cost-effective device that is capable of feeding cigarette packets out of a packing machine and that overcomes the above mentioned problem.

Accordingly, the present invention provides a device for feeding cigarette packets out of a packing machine equipped with a conveyor for stabilising the packets, which are substantially in the shape of parallelepipeds, the conveyor having two facing belts designed to engage the small lateral faces of the packets in such a way that the packets are moved forward with their large lateral faces in contact with each other along a first stabilising path in a given direction transversal to the large lateral faces, the device being characterised in that, downstream of the stabilising conveyor, it comprises a unit for printing on the packets, which in turn comprises spacing conveyor means that separate the packets from each other and feed them along a second path along which the packets are spaced out, and at least one printing device located at a printing position on a section of the second path.

The invention will now be described with reference to the accompanying drawings, which illustrate preferred embodiments of it and in which.

Figure 1:
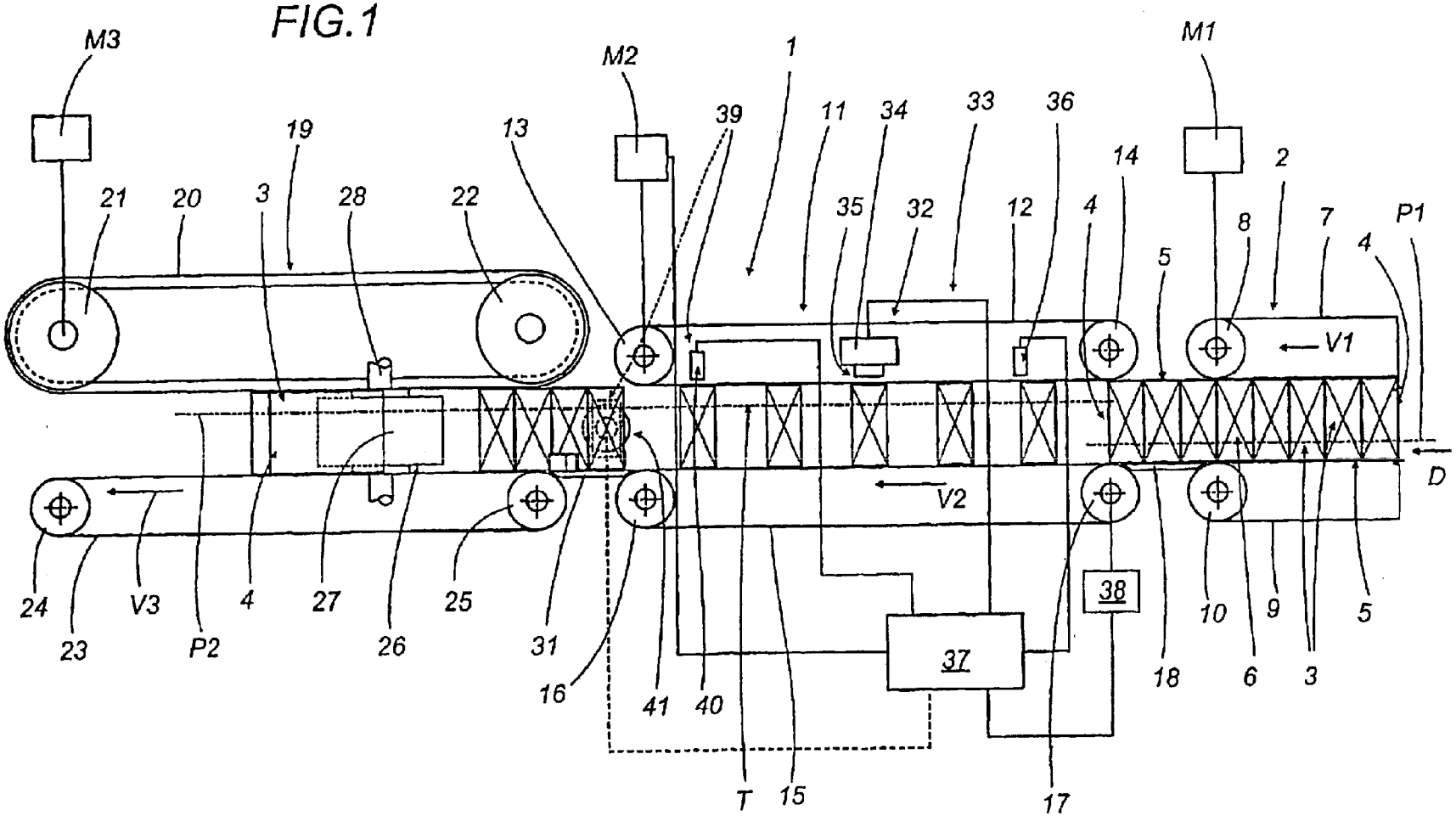
FIG. 1 is a schematic front view, with some parts cut away to better illustrate others, of a device according to the present invention for feeding cigarette packets out of a packing machine.
Figure 2:
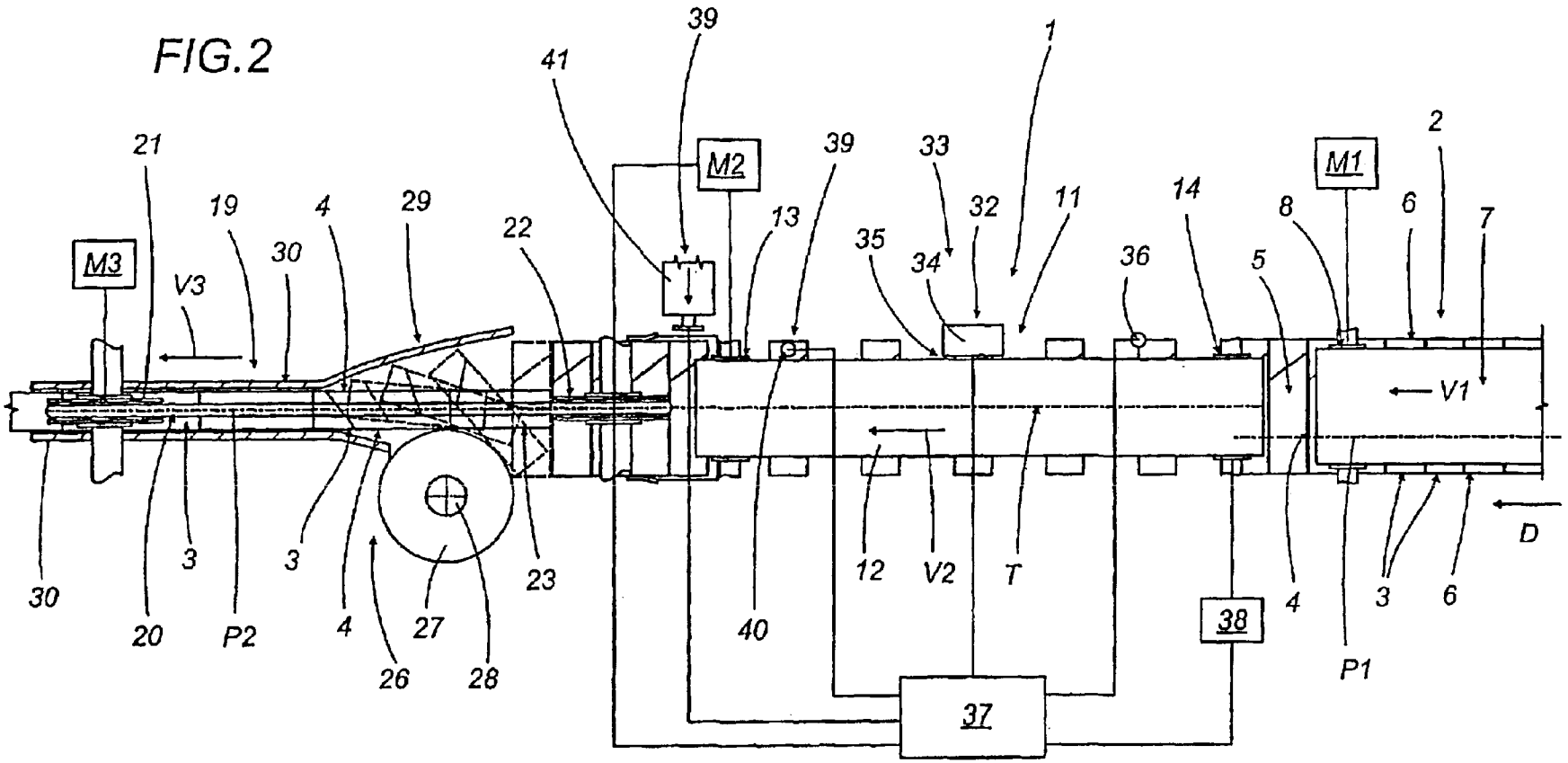
FIG. 2 is a schematic plan view, with some parts cut away to better illustrate others, of the device shown in FIG. 1.

With reference to FIGS. 1 and 2, the numeral 1 indicates as a whole an outfeed device of a packing machine of known type (not illustrated) which has a conveyor 2 for stabilising the cigarette packets 3 feeding out of the packing machine, said packets 3 being substantially in the shape of parallelepipeds and having two large lateral faces 4, two small lateral faces or sides 5 and two end faces or ends 6. The conveyor 2 comprises an upper endless belt 7 running around two end pulleys 8 (only one of which is illustrated) and one of which is driven by a motor M1, and a lower endless belt 9 running around two end pulleys 10 (only one of which is illustrated) and one of which is driven by a link of known type (not illustrated) which connects it to the pulley 8 of the upper belt 7.

The corresponding branches of the two belts 7 and 8, which are substantially as wide as the packets 3 are long, face each other and are designed to engage the small lateral faces 5 of the packets 3, which are positioned with their large lateral faces 4 in contact with each other, in such a way as to feed the packets 3 along a first stabilising path P1, in a direction D transversal to the large lateral faces 4, and at a first defined speed V1.

Downstream of the stabilising conveyor 2, there is a spacing conveyor 11 comprising an upper endless belt 12 running around two end pulleys 13 and 14, at least one of which, namely, the one located further downstream and labelled 13, is driven by a motor M2 that is independent of the motor M1, and a lower endless belt 15 running around two end pulleys 16 and 17, at least one of which, namely, the one located further downstream and labelled 16, presents an axis parallel to the axis of the upper pulley 13 and is driven by a link of known type (not illustrated) which connects it to the pulley 13 itself.

The corresponding branches of the two belts 12 and 15, whose width is smaller than the length of the packets 3, face each other and are designed to engage the small lateral faces 5 of the packets 3, in such a way as to feed the packets 3 along a second path P2 in direction D at a second defined speed V2 faster than V1, so that the packets 3 feeding along the second path P2 are spaced out and so that two end portions of their small lateral faces 5 are left free. Looking in more detail, a fixed bridge 18 spanning the gap between the upper branches of the belts 9 and 15 constitutes a connecting element allowing the packets 3 to be transferred from the stabilising conveyor 2 to the spacing conveyor 11.

Downstream of the spacing conveyor 11, there is a conveyor 19 for turning the packets 3, which comprises an upper endless belt 20, with a circular cross section, running around two end pulleys 21 and 22, at least one of which, namely, the one located further downstream and labelled 21, is driven by a motor M3 that is independent of the motors M1 and M2, and a lower endless belt 23 running around two end pulleys 24 and 25, at least one of which, namely, the one located further downstream and labelled 24, presents an axis parallel to the axis of the upper pulley 21 and is driven by a link of known type which connects it to the pulley 21 itself.

At the infeed end of the conveyor 19, there is a device 26 for turning the packets 3, which comprises, on one side of the second feed path P2 along which the conveyor 19 extends, a contact roller 27 which is rotatably supported by a vertical shaft 28, and on the opposite side, an arched guide 29 that operates in conjunction with the roller 27 to turn the packets 3 through 90 degrees about a vertical axis as they are moved forward by the belts 20 and 23 against the contrasting action of the roller 27 on one of the two ends of each packet 3.

Once the packets 3 have been turned, they are spaced out and fed forward by the two belts 20 and 23 between two straight guides 30 (illustrated in FIG. 2) along the path P2 at a third speed V3 higher than the speed V2 and in the direction D parallel to the large lateral faces 4 of the packets 3.

A fixed bridge 31 spanning the gap between the upper branches of the belts 15 and 23 constitutes a connecting element allowing the packets 3 to be transferred from the spacing conveyor 11 to the conveyor 19 that turns the packets 3 themselves.

As shown in FIGS. 1 and 2, at the spacing conveyor 11, there is a printing device 32 which, together with the spacing conveyor 11 itself, constitutes a printing unit 33 which comprises printing means 34 located at a defined printing position 35 on a section T of the second path P2.

Figure 4:
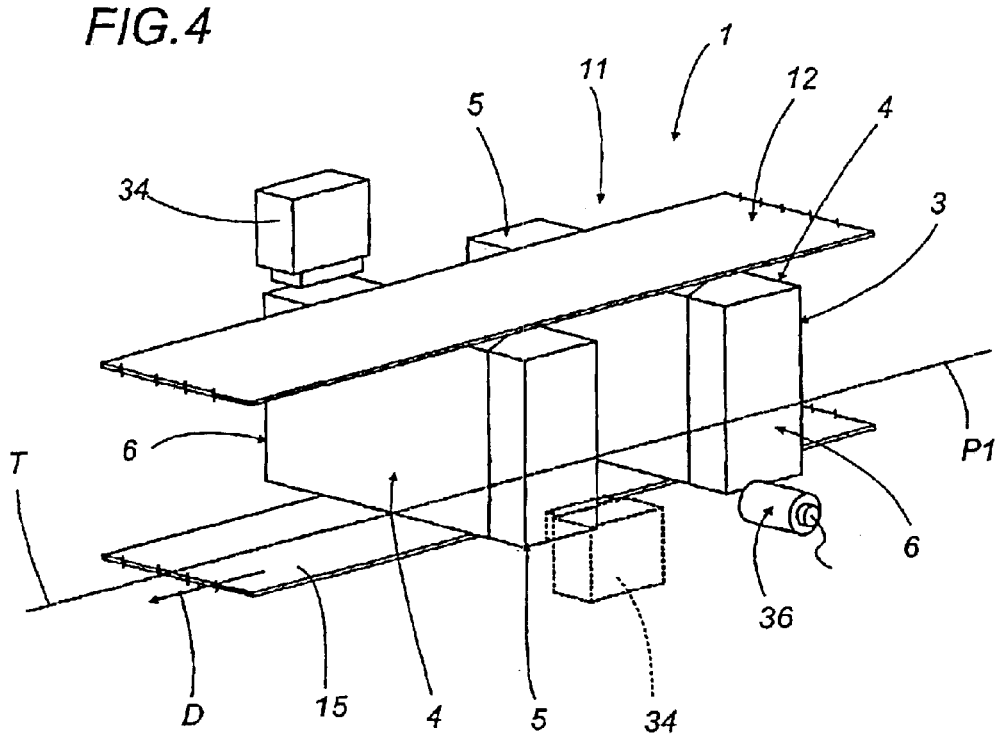
FIGS. 4 and 5 are schematic perspective views of details of the embodiments illustrated in FIGS. 1 and 3, respectively.

In the embodiment illustrated in FIGS. 1, 2 and 4, the printing unit 33 comprises activation and control means which in turn comprise a probe 36 designed to detect the presence of each is packet 3 and to generate a signal indicating the precise moment in which each packet 3 reaches the position occupied by the probe 36, the packet 3 being spaced from the two packets preceding and following it along the spacing conveyor 11, as described above. The signal from the probe 36 reaches a control unit 37 that also receives a signal issued by a sensor 38, consisting for example of an encoder connected to the pulley 17 and designed to detect the instantaneous position of the spacing conveyor 11 relative to each packet 3 on the basis of the signal issued by the probe 36, and to send control signals to the control unit 37. The unit 37 is therefore capable of determining an instantaneous timed relation between the packets 3 and the conveyor 11 and of sending to the aforementioned printing means 34 a plurality of control signals which enable a desired sequence of characters and codes to be printed on defined portions of the faces of the packets 3.

The printing unit 33 comprises a detection and rejection unit 39 comprising a print detecting sensor 40, located on the conveyor 11 downstream of the printing means 34 and connected to the control unit 37 which is in turn connected to an ejecting device 41 forming part of the unit 39 and located at the bridge 31 connecting the conveyor 11 to the packet 3 turning conveyor 19. The ejector 41 may be, for example, of the pneumatic type and ejects the packets 3 with print defects detected by the sensor 40.

The printing means 34 may be of the inkjet or laser type, for example Domino DDC3 laser code printers.

As shown in FIG. 4, the printing means 34 may be located along the conveyor 11 either facing the sides 5 of the packets 3 (see the block 34 drawn with a continuous line) so as to print the characters and codes on the end portions of the sides 5 which are free from the belts 12 and 15, or facing the ends 6 of the packets 3 (see the block 34 drawn with a dashed line) so as to print on the ends 6.

Figure 3:
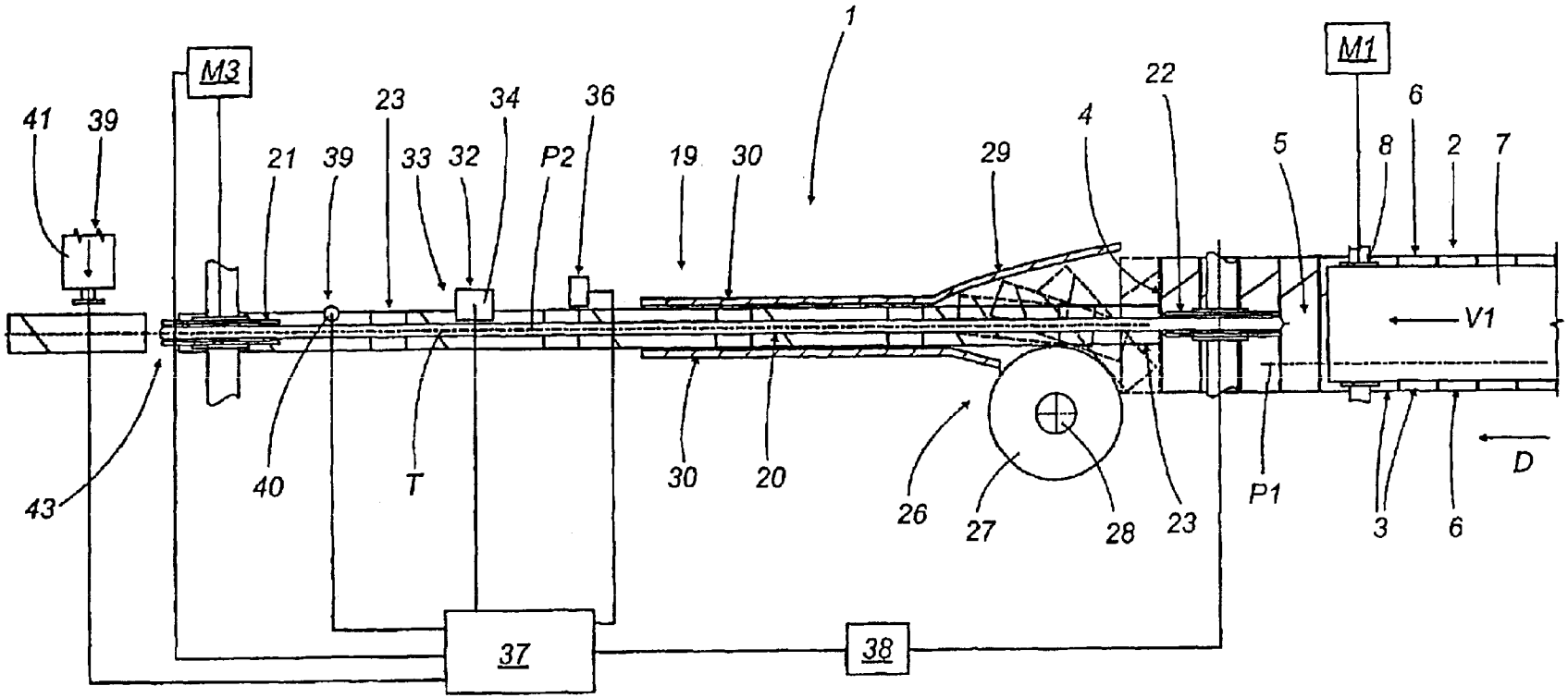
FIG. 3 is a schematic plan view, with some parts cut away to better illustrate others, of another embodiment of the device shown in FIG. 1.

In the embodiment illustrated in FIG. 3, the conveyor 19 that turns the packets 3 is located immediately downstream of the stabilising conveyor 2 and on it the packets 3 are also spaced out. The conveyor 19 comprises the aforementioned printing device 32 and, together with the latter, constitutes the aforementioned printing unit 33.

The description of the printing unit 33 for the embodiment illustrated in FIGS. 1 and 2 also applies to the embodiment illustrated in FIG. 3, since the printing unit 33 works in the same way, including the packet 3 detection and rejection unit 39 which, in this case, is located downstream of the printing device 32 on the conveyor 19 in a position such as to enable the defective packs 3 to be rejected. Looking in more detail, the sensor 40 which detects the print is located on the conveyor 19 downstream of the printing means 34 and is connected to the control unit 37 which is in turn connected to the ejection device 41 located at the outfeed end 42 of the conveyor 19 itself.

In the embodiment illustrated in FIG. 3, the signal from the probe 36 reaches the control unit 37 that also receives the signal issued by the sensor 38, consisting for example of an encoder connected to the pulley 22 and designed to detect the instantaneous position, in this case, of the conveyor 19 relative to each packet 3 on the basis of the signal issued by the probe 36, and to send control signals to the control unit 37. The unit 37 is therefore capable of determining an instantaneous timed relation between the packets 3 and the conveyor 19 and of sending to the aforementioned printing means 34 a plurality of control signals which enable a desired sequence of characters and codes to be printed on defined portions of the faces of the packets 3.

Figure 5:
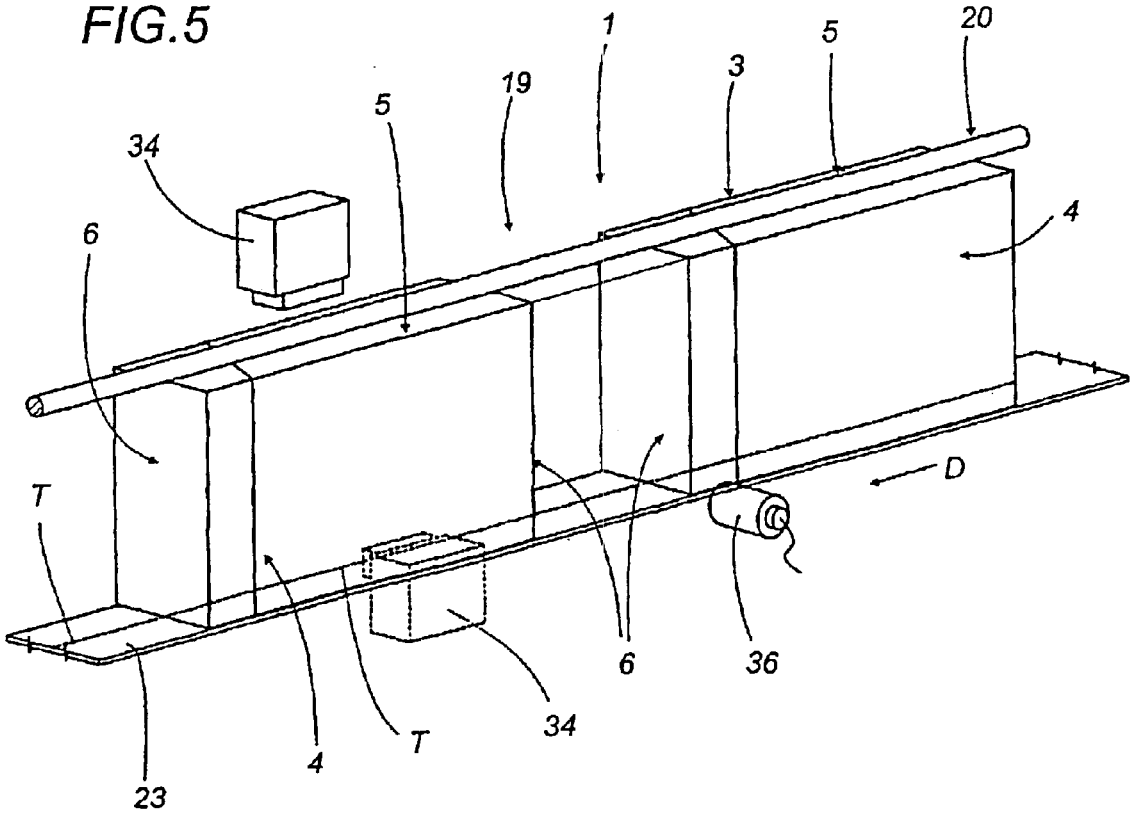

As shown in FIG. 5, the printing means 34 may be located along the conveyor 19 either facing the small lateral faces or sides 5 of the packets 3 (see the block 34 drawn with a continuous line) so as to print the characters and codes on the end portions of the side 5 which are free from the belt 20, or facing the large lateral faces 4 of the packets 3 (see the block 34 drawn with a dashed line) so as to print on the large lateral faces 5. For this reason, as shown in FIG. 3, the straight guides 30 extend only partially along the conveyor 19, stopping approximately half way along the conveyor 19, where the packets are already firmly held by the belts 20 and 23, so that the printing means 34 can be positioned at any point relative to the faces 4 of the packets 3 to print on any part of the faces 4.

Figure 6:
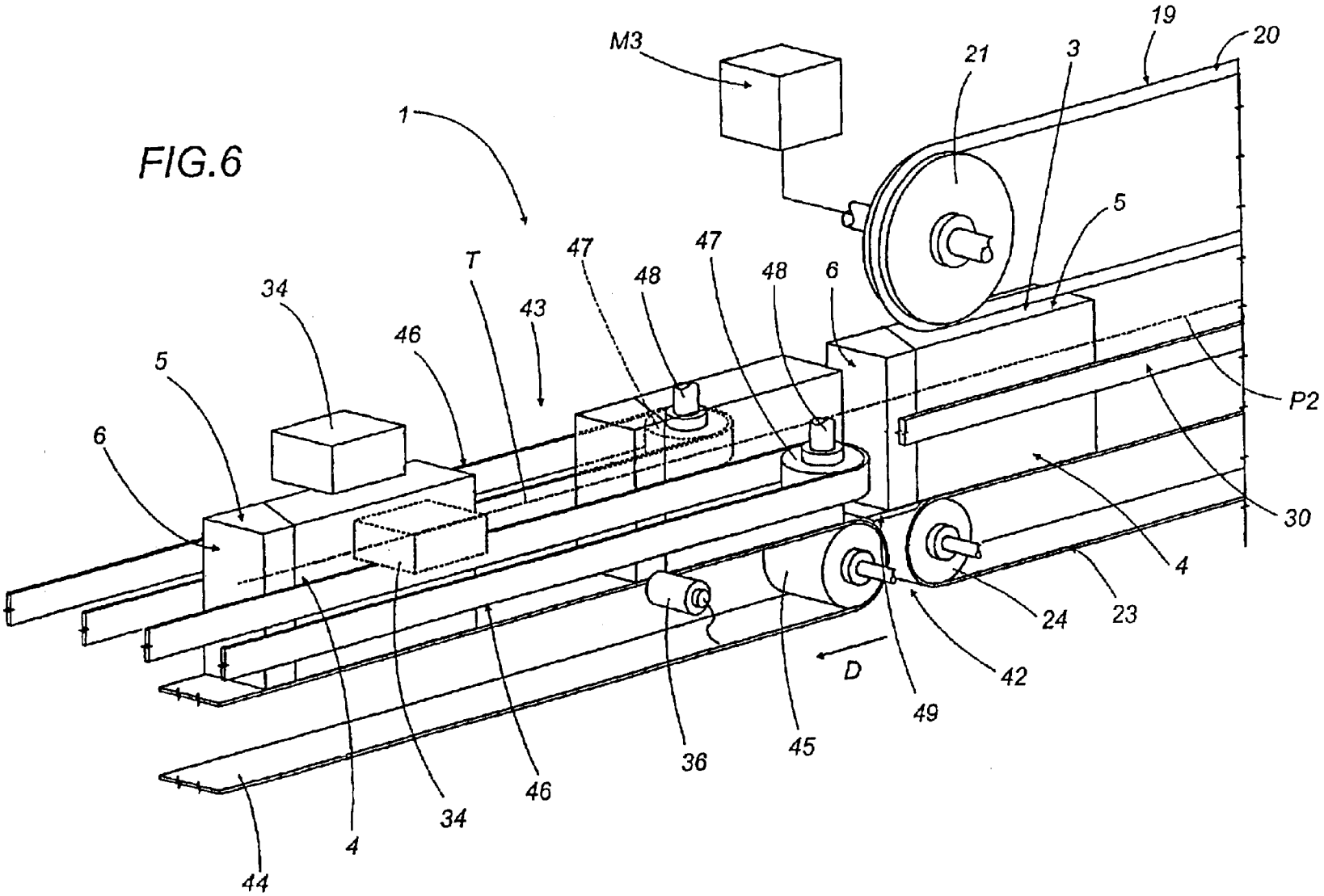
FIG. 6 is a schematic perspective view of yet another embodiment of the device according to the present invention for feeding cigarette packets out of a packing machine.

In the third embodiment illustrated in FIG. 6, the printing unit 33 is located downstream of the outfeed end 42 of the packet 3 turning conveyor 19, which is in turn located at the outfeed end of the stabilising conveyor 2. In this embodiment, whereas the packet 3 turning conveyor 19 is exactly equivalent to the conveyor 19 described with reference to FIGS. 1 and 2, the printing unit 33 comprises another conveyor 43 which in turn comprises a lower horizontal endless belt 44 parallel to the packet 3 feed path P2 and running around two end pulleys 45, only one of which is illustrated, namely, the one facing the outfeed end 42 of the conveyor 19, and at least one, namely the one further downstream (not illustrated) is driven by a motor of the known type which is not illustrated and which is independent of the motor M3 that drives the pulley 21 of the conveyor 19.

The conveyor 43 further comprises two parallel conveyor belts 46 located on opposite sides of the path P2 and facing and in contact with the large lateral faces 4 of the packets 3 in such a way as to space them out and feed them along the second path P2 in the direction D which is parallel to the large lateral face 4 of each packet 3. Each belt 46 is endless and runs around two corresponding pulleys 47. Of these pulleys, only the ones located upstream relative to the packet 3 feed direction D, close to the outfeed end 42 of the conveyor 19, are illustrated, each of these being mounted on a vertical shaft 48.

Like the embodiments illustrated in FIGS. 1, 2 and 3, a fixed bridge 49 spanning the gap between upper branches of the belt 23 and 44, constitutes a connecting element allowing the packets 3 to be transferred from the packet 3 turning conveyor 19 to the conveyor 43.

In this particular embodiment, as shown in FIG. 6, the printing means 34 are located along the conveyor 43, either facing the small lateral faces or sides 5 of the packets 3 (see the block 34 drawn with a continuous line) so as to print the characters and codes on the faces 5, and more precisely on substantially central portions of the faces 5, the faces 5 themselves being free of the transfer belts, or facing the large lateral faces 4 of the packets 3 (see the block 34 drawn with a dashed line) so as to print on the portions of the faces 4 which are free of the belts 46.

One of the advantages of the printing unit 33 is that the spacing of the packets 3 along the second path P2 allows the printing means 34 to print on two parallel lines of the same printing portion on any lateral face of each packet 3. Indeed, on account of their constructional characteristics, laser printers are unable to print two lines of characters on a succession of packets that are in contact with each other.

What is claimed is:

1. A device for feeding cigarette packets out of a packing machine equipped with a conveyor for stabilizing the packets, which are substantially in the shape of parallelepipeds, the conveyor having two facing belts designed to engage the small lateral faces of the packets in such a way that the packets are moved forward with their large lateral faces in contact with each other along a first stabilizing path in a given direction transversal to the large lateral faces wherein, downstream of the stabilizing conveyor, the device further comprises a unit for printing on the packets, which in turn comprises spacing conveyor means that separate the packets from each other and feed them along a second path along which the packets are spaced out, and at leaf one printing device located at a printing position on a section of the second path.

2. The device according to claim 1, wherein the printing unit comprises corresponding printing means located at the spacing conveyor means.

3. The device according to claim 2, wherein it comprises means for activating and controlling the printing means located on the section of the second path.

4. The device according to claim 3, wherein the activation and control means comprise at least one probe of detecting the presence of each packet.

5. The device according to claim 4, wherein the activation and control means comprise sensor means designed to detect the instantaneous position of the spacing conveyor means in synchronised relation with the detection of the presence of each packet and to send to the printing means a plurality of signals that control the printing of a succession of characters on defined portions of each packet.

6. The device according to claim 2, wherein the printing means are of the laser type.

7. The device according to claim 2, wherein the printing means are of the inkjet type.

8. The device according to claim 2, wherein, downstream of the printing means, it comprises means of detecting the print on each packet.

9. The device according to claim 8, wherein, on the section of the second path, it comprises a device for rejecting the packets controlled by the print detection means.

10. The device according to claim 9, wherein the rejection device is of the pneumatic type.

11. The device according to claim 2, wherein the spacing conveyor means comprise a device for turning the packets.

12. The device according to claim 1, wherein the spacing conveyor means comprise a device for turning the packets.

13. The device according to claim 12, wherein the spacing conveyor means are located between the stabilizing conveyor and the device for turning the packets.

14. The device according to claim 13, wherein the printing device is located downstream the device for turning the packets.

15. The device according to claim 2, wherein the spacing conveyor means comprise two facing belts which are driven by independent motor means and which are designed to engage the small lateral faces of the packets in such a way as to move the packets forward in the direction at a defined feed speed higher than the speed of the stabilizing conveyor.

16. The device according to claim 12, wherein the printing device is located downstream of the device for turning the packets.

17. The device according to claim 12, wherein the device for turning the packets comprises a conveyor comprising two facing belts designed to engage the small lateral faces of the packets so as to turn, space out and feed the packets forward in the direction parallel to the large lateral face of each packet.

18. The device according to claim 12, wherein the device for turning the packets comprises a conveyor comprising two facing belts designed to engage the large lateral faces of the packet to space them out and feed the packets themselves forward in the direction parallel to the large lateral face of each packet.

19. The device according to claim 1, wherein the spacing conveyor means comprise two facing belts which are driven by independent motor means and which are designed to engage the small lateral faces of the packets in such a way as to move the packets forward in the direction at a defined feed speed higher than the speed of the stabilizing conveyor.

20. The device according to claim 19, wherein the width, measured transversally to the feed direction, of at least one of the two belts of the spacing conveyor means is smaller than the length of the small lateral faces of the packets.

21. A device for feeding cigarette packets out of a packing machine equipped with a conveyor for stabilizing the packets, which are substantially the shape of parallelepipeds, the conveyor having two facing belts designed to engage the small lateral faces of the packets in such a way that the packets are moved forward with their large lateral faces in contact with each other along a first stabilizing path in a given direction transversal to the large lateral faces, wherein, downstream of the stabilizing conveyor, the device comprises a unit for printing on the packets, which in turn comprises spacing conveyor means that separate the packets from each other and feed them along a second path along which the packets are spaced out, and at least one printing device located at a printing position on a section of the second path; the device further comprising printing means located at the spacing conveyor means and means for activating and congolling the printing means located on the section of the second path, said activation and control means comprising at least one probe for detecting the presence of each packet and sengor means designed to detect the instantaneous position of the spacing conveyor means synchronised relation with the detection of the presence of each packet and to send to the printing means a plurality of signals that control the printing of a succession of characters on defined portions of each packet.

* * * * *